United States Patent [19]

Frimer

[11] Patent Number: 4,607,561

[45] Date of Patent: Aug. 26, 1986

[54] FIREARM REST

[76] Inventor: Itzchak Frimer, 75 Hayarkon St., Bnei Brak, Israel

[21] Appl. No.: 631,912

[22] Filed: Jul. 18, 1984

[30] Foreign Application Priority Data

Aug. 24, 1983 [IL] Israel ..... 69567

[51] Int. Cl.[4] ..... F41C 29/00

[52] U.S. Cl. ..... 89/37.04

[58] Field of Search ..... 42/94; 89/37.03, 37.04, 89/40.06

[56] References Cited

U.S. PATENT DOCUMENTS 681,439 8/1901 Carr ..... 89/40.06

1,618,966 2/1927 Bull ..... 42/94

FOREIGN PATENT DOCUMENTS 111655 1/1917 United Kingdom ..... 89/40.06

*Primary Examiner*—Stephen C. Bentley

*Attorney, Agent, or Firm*—Fiddler & Levine

[57] ABSTRACT

A firearm rest including a housing, two legs coupled to the housing, and firearm mounting apparatus rotatably mounted on the housing. According to a preferred embodiment, the firearm mounting means includes a mounting element rotatably mounted on the housing and arranged for rotation about an axis parallel to the plane defined by the legs, and a firearm mounting plate pivotably mounted on the mounting element and arranged for pivoting about an axis perpendicular to the plane defined by the legs.

3 Claims, 8 Drawing Figures

FIREARM REST

FIELD OF THE INVENTION

The present invention relates to firearm rests in general and, in particular, to bipod rests for sniper rifles.

BACKGROUND OF THE INVENTION

Precise positioning and aiming of firearms is of particular importance in many circumstances. In particular, it is crucial for successful firing of a sniper rifle so as to hit the desired target.

At present, positioning and aiming of rifles is accomplished by means of bipods to which the rifle is affixed. The bipods in use today consist of a plate on which the rifle is mounted and a pair of telescoping legs. The legs, which may be closed together for ease of transportation, are spread apart to the open position and each of the legs is extended the desired amount to provide the height required by the sniper.

Bipods of this sort suffer from a number of disadvantages. Telescoping legs are not particularly strong so they have a tendency to bend. Precise positioning is difficult since the plate on which the rifle is mounted is rigidly fixed to the legs. This means that rotation through the azimuth is not possible, nor is rotation about an axis perpendicular to the plane of the legs.

SUMMARY OF THE INVENTION

It is therefore an object of the present invention to provide a strong bipod for a sniper rifle which permits rapid, easy and precise positioning and aiming.

There is thus provided in accordance with the present invention a firearm rest including a housing, two legs coupled to the housing, and firearm mounting apparatus rotatably mounted on the housing. According to a preferred embodiment, the firearm mounting means includes a mounting element rotatably mounted on the housing and arranged for rotation about an axis parallel to the plane defined by the legs, and a firearm mounting plate pivotably mounted on the mounting element and arranged for pivoting about an axis perpendicular to the plane defined by the legs.

According to a preferred embodiment of the present invention, there is provided a firearm rest including a housing, firearm mounting apparatus coupled to the housing, and two unitary legs coupled to the housing and arranged for complementary reciprocal motion. In particular, the rest further includes apparatus for selectably locking the legs in at least one orientation whereby an angle less than or equal to a straight angle is defined therebetween.

In accordance with a preferred embodiment of the invention, the legs define interlocking toothed portions at one end thereof and the apparatus for selectable locking includes apparatus for selectably engaging at least one of the toothed portions. According to one preferred embodiment, the apparatus for engaging includes ratchet means. According to an alternative preferred embodiment, the apparatus for engaging includes a pivotable engagement member and apparatus for pivoting the engagement member.

Further according to a preferred embodiment, there is provided a sniper rifle rest including a housing defining a mounting socket, two unitary legs coupled to the housing and arranged for complementary reciprocal motion, and firearm mounting apparatus rotatably mounted in the mounting socket. In particular according to a preferred embodiment, the firearm mounting apparatus includes a mounting element rotatably mounted in the socket and arranged for rotation about an axis parallel to the longitudinal axis of the aperture, and a firearm mounting plate pivotably mounted on the mounting element and arranged for pivoting about an axis perpendicular to the plane defined by the legs.

Still further according to a preferred embodiment, the sniper rifle rest also includes apparatus for selectably locking the legs in at least one orientation whereby an angle less than or equal to a straight angle is defined therebetween.

According to a preferred embodiment, each of the legs defines a toothed portion at one end thereof, the toothed portions being interlocked with one another, and the apparatus for selectably locking includes apparatus for selectably engaging at least one of the toothed portions. According to one preferred embodiment, the apparatus for engaging includes ratchet means. According to an alternative preferred embodiment, the apparatus for engaging includes a pivotable engagement member and apparatus for pivoting the engagement member.

BRIEF DESCRIPTION OF THE DRAWINGS

The apparatus of the present invention will be further understood and appreciated from the following detailed description taken in accordance with the drawings wherein.

DETAILED DESCRIPTION OF THE INVENTION

For convenience of description, the firearm rest of the present invention will be described hereinbelow with reference to a sniper rifle rest, for which application it is particularly suited. However, it will be appreciated that the invention is equally useful as a rest for any firearm which requires a portable, rapid and accurate positioning and aiming apparatus.

Figure 1:
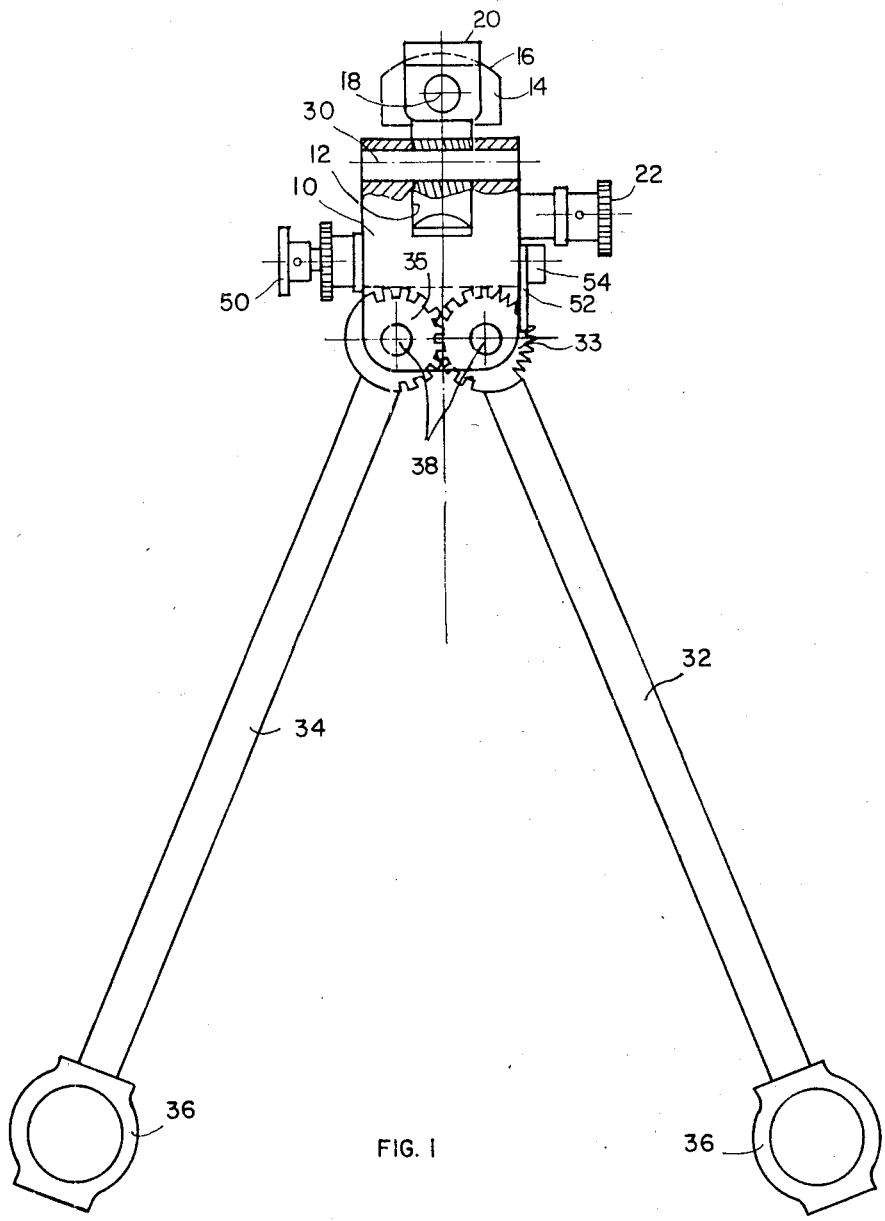
FIG. 1 is a partially cut away front view illustration of a rifle rest constructed and operative in accordance with an embodiment of the present invention.
Figure 2:
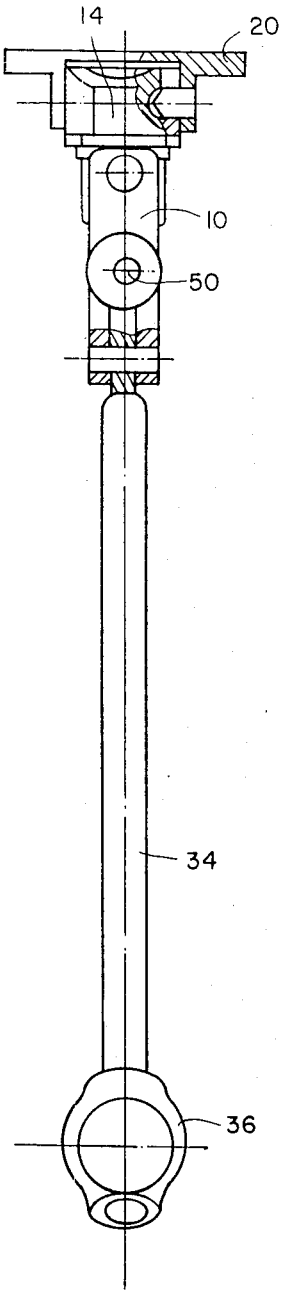
FIG. 2 is a side view illustration of the rifle rest of FIG. 1.

With reference to FIGS. 1 to 5, there is shown a sniper rifle rest constructed and operative in accordance with a preferred embodiment of the present invention. With particular reference to FIGS. 1 and 2, the rifle rest comprises a housing 10 defining an socket 12. Rotatably mounted within socket 12 is a mounting element 14. Mounting element 14 is rotatable about the longitudinal axis of socket 12 so as to provide accuracy of positioning and aiming through the azimuth.

Mounting element 14 is preferably provided with a rounded top surface 16. Pivotably mounted on mounting element 14 as by pin 18 is a rifle mounting plate 10. The rifle or other firearm is affixed to the mounting plate 20 by any conventional means and may remain affixed thereto even during transport of the rifle. Rifle mounting plate 20 is adapted to pivot through a predetermined angle about the top surface 16 of mounting element 14 so as to permit fine adjustment of positioning in the common event the earth under the legs of the bipod is uneven.

It is a particular feature of the firearm rest of the present invention that precision and accuracy of positioning and aiming are tremendously enhanced due to the rotatability and pivotability of the firearm mounting. This permits easy and accurate compensation for imprecise positioning of the legs of the bipod without requiring repositioning of the entire rest, as required by prior art devices.

Mounted within housing 10 is a release element 22. With additional reference to FIG. 3, it can be seen that release element 22 comprises a pin 24 disposed within spring means 26 mounted through one side wall of housing 10. During operation, pin 24 is seated within an aperture 28 in mounting element 14 thus retaining mounting element 14 and housing 10 fixed in the orientation of FIG. 1. However, when it is desired to move the rifle and the rest to which it is attached, release element 22 is pulled outwardly, thereby tensioning spring means 26, and removing pin 24 from aperture 28 in the mounting element. Mounting element 14, mounting plate 20 and the attached rifle may now be rotated with respect to housing 10 about axis 30 to a carrying orientation wherein the legs of the bipod lie parallel to and adjacent the rifle.

Referring once again to FIGS. 1 and 2, the firearm rest of the present invention further includes two unitary legs 32 and 34 which may be provided with foot elements 36 for stability on the ground. According to the embodiment of FIGS. 1 to 5, legs 32 and 34 each define respective toothed portions 33 and 35 at one end thereof. Legs 32 and 34 are pivotably mounted as about pins 38 in the lower portion of housing 10. They are mounted such that their respective toothed portions are interlocking whereby pivotal movement of either leg 32 or leg 34 causes complementary reciprocal pivotal movement of the other leg.

The firearm rest of the present invention may be constructed of steel, aluminum, plastic or any other relatively light weight yet sturdy material.

It is a particular feature of the firearm rest of the present invention that each of the legs of the bipod comprises a unitary structure which may, for example, be extruded or cut from metal tubing of suitable width and diameter. They are thus much stronger than telescoping legs, are much simpler and cheaper to manufacture, and require less care. In addition, the interlocking structure provides equal opening of each leg so that one leg will not be longer than the other which contributes to the stability of the firearm rest while in use.

Figure 4:
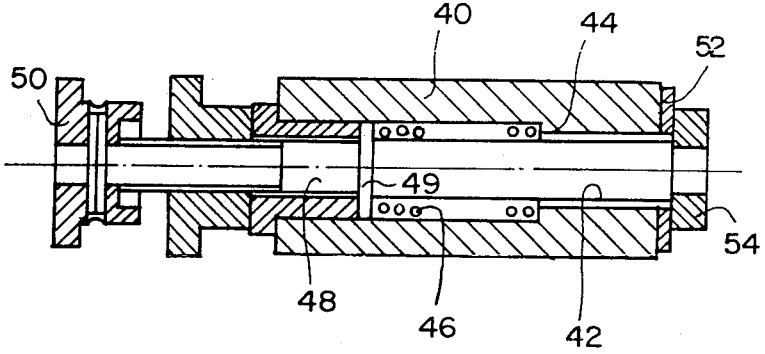
FIG. 4 is a cut away top view illustration along line B—B of FIG. 1.
Figure 3:
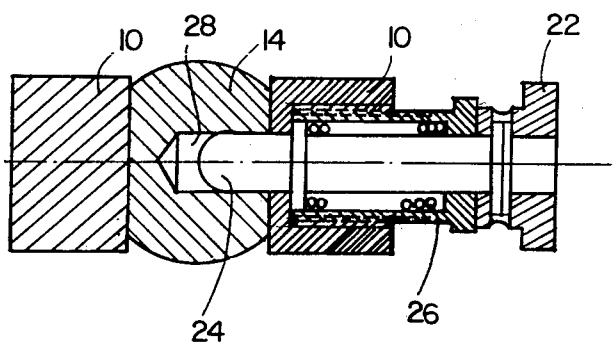
FIG. 3 is a cut away bottom view illustration along line A—A of FIG. 1.
Figure 5:
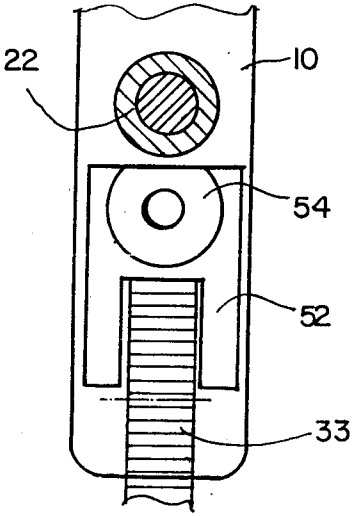
FIG. 5 is a side view illustration of portion G—G of FIG. 1.

Referring additionally to FIGS. 4 and 5, it is shown that the legs of the rifle rest of the embodiment of FIG. 1 are retained in the desired orientation by ratchet means which permit selectable pivoting in one direction only and prevent pivoting in the other direction. In the illustrated embodiment, the ratchet means includes a body 40 defining a central bore 42 having shoulders 44. Seated within bore 42 in engagement with shoulders 44 is spring means 46. Mounted within bore 42 and within spring means 46 is a pin 48. Pin 48 defines a collar 49 which rests in engagement with spring means 46. Pin 48 also defines an actuator 50 at one end thereof. Mounted upon the other end of pin 48 is a u-shaped locking plate 52 which is retained on pin 48 as by bolt 54.

Locking plate 52 is arranged so as to straddle toothed portion 33 of leg 32 and to rest between adjacent teeth thereof. When leg 32 is rotated in a clockwise direction about pin 38, locking plate 52 and pin 48, on which it is mounted, are pushed outwardly by the tooth behind plate 52. This causes collar 49 to engage spring means 46 thereby tensioning the spring. As soon as this tooth has rotated sufficiently to disengage locking plate 52, spring means 46 expands forcing collar 49 back to its original position which, in turn, pulls locking plate 52 back into contact with housing 10 and into seating engagement between adjacent teeth of leg 32.

Ordinarily, counter-clockwise motion of leg 32 is prevented by locking plate 52. This permits rapid and stepwise height adjustment of the rifle rest from its lowest position, i.e., when the angle defined by the legs of the bipod is 180°, to its heighest position, i.e., when the angle defined thereby is 0°, with efficient locking at any desired height or angle in between.

In order to release leg 32 when opening the rifle rest, one merely presses actuator 50 inwardly towards housing 10. Pressing actuator 50 causes pin 48 to slide through bore 42, causing collar 49 to engage and tension spring means 46 and pushing locking plate 52 out of seating engagement with the teeth of toothed portion 33 of leg 32. Leg 32 is now free to rotate any amount in either direction and may, for example, be rotated completely in a counter-clockwise direction so as to permit the rifle rest to seat flat on the ground. Releasing acutator 50 causes spring means 46 to expand whereby locking plate 52 is brought back into seating engagement between adjacent teeth of leg 32.

Figure 7:
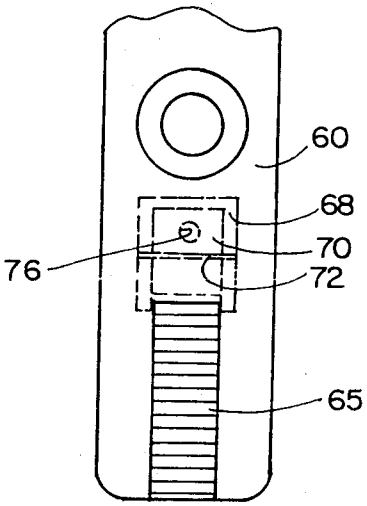
FIG. 7 is a side view illustration of portion G—G of FIG. 6.
Figure 6:
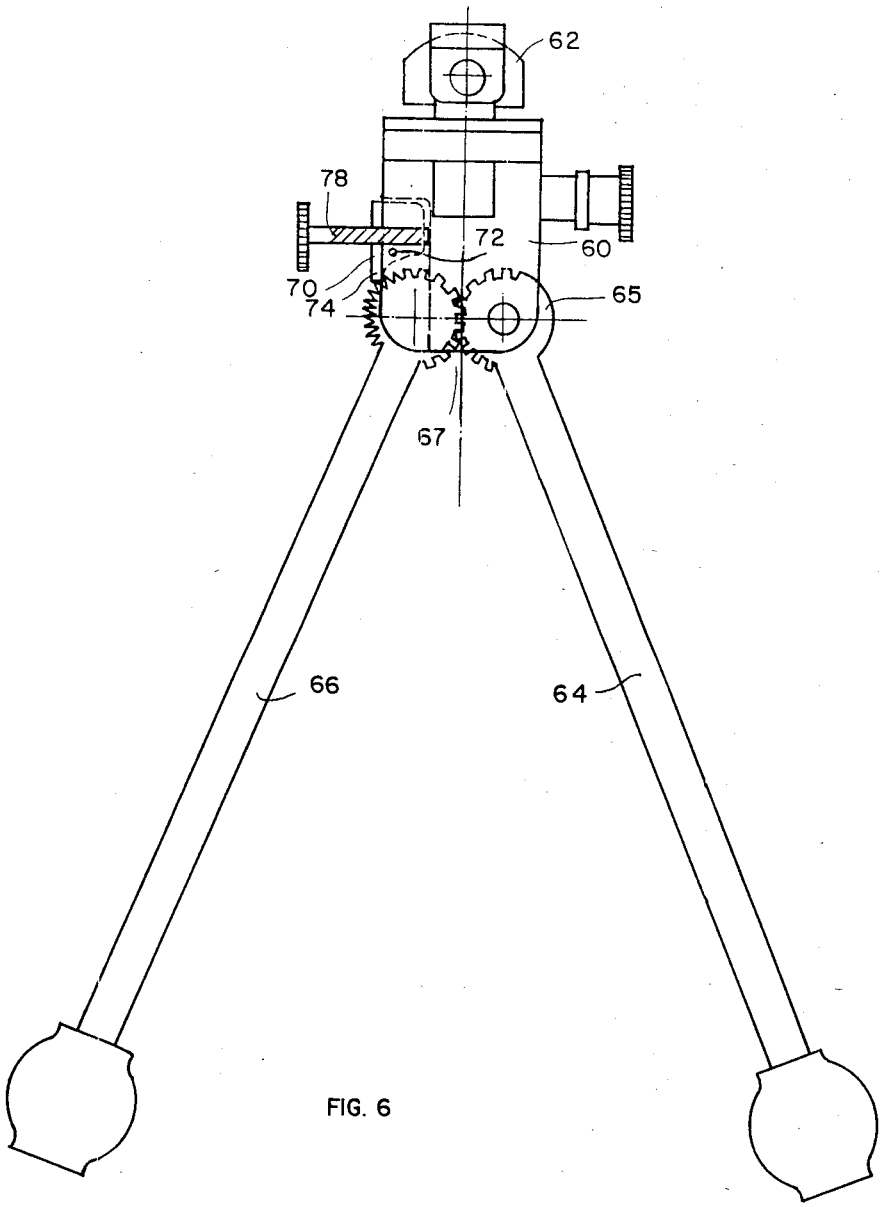
FIG. 6 is a partially cut away front view illustration of a rifle rest designed and constructed in accordance with an alternate embodiment of the present invention.
Figure 8:
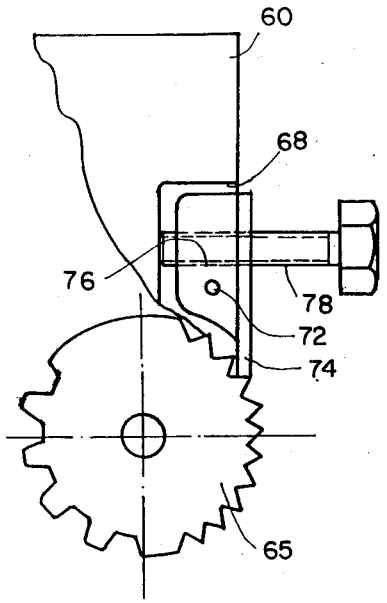
FIG. 8 is a cut away front view illustration of one embodiment of a leg of the rifle rest of FIG. 6 and associated locking means.

Turning now to FIGS. 6, 7 and 8 there is shown a rifle rest constructed and operative in accordance with an alternate embodiment of the present invention. The rifle rest of FIG. 6 comprises a housing 60, a rifle mounting element 62 and two unitary legs 64 and 66 defining respective toothed portions 65 and 67. Mounting element 62 and legs 64 and 66 are substantially identical to those described with reference to FIGS. 1 through 5.

Housing 60 defines a groove 68. Pivotably mounted within groove 68 as about a pin 72 is a locking element 70. Locking element 70 defines a finger portion 74 which is arranged to extend between and into engagement with adjacent teeth of tooth portion 65 of leg 64. Locking element 70 defines a threaded bore 76 through which passes screw means 78. Tightening or loosening screw means 78 causes locking element 70 to pivot into and out of engagement with tooth portion 65. Alternatively, any other means of pivoting locking element 70 selectably into engagement with the teeth of leg 64 may be employed.

The operation of the rifle rest of this embodiment of the present invention is substantially similar to that described above with reference to FIGS. 1 to 5. When it is desired to position the rifle, screw means 78 is loosened so as to disengage locking element 70 from toothed portion 65 of leg 64. The legs may then be spread apart to define an angle of 180° therebetween. To adjust the height of the rest, the rifle is lifted slowly whereby the angle defined by the legs decreases until the rifle reaches the desired height. Screw means 78 is now tightened, forcing locking element 70 into engagement between two teeth of toothed portion 65, thus retaining the legs fixed in the desired orientation. Readjustment of the height may be readily accomplished by loosening the screw means sufficiently to permit rotation of leg 64 and then tightening the screw means once again to lock the bipod in position for aiming and firing.

It will be appreciated by those skilled in the art that the present invention is not limited to what has been described and shown hereinabove by way of example. Rather the scope of the invention is limited solely by the claims which follow.

I claim:

1. A firearm rest comprising:

a housing;

two legs coupled to said housing and being arranged for complementary reciprocal motion, said legs defining interlocking toothed portions at one end thereof, such that the position of one leg determines the position of the other;

means for selectably locking the legs in at least one selectable orientation and including ratchet means for selectably engaging one of said toothed portions, thereby determining the position of both legs and the height of the housing; and firearm mounting means rotatably mounted on said housing.

2. A firearm rest according to claim 1 and wherein said firearm mounting means comprises:

a mounting element rotatably mounted on said housing and arranged for rotation about an axis parallel to the plane defined by said legs; and a firearm mounting plate pivotably mounted on said mounting element and arranged for pivoting about an axis perpendicular to the plane defined by said legs.

3. A firearm rest according to claim 2 and wherein said axis parallel to the plane defined by said legs lies perpendicular to the line bisecting the angle defined by said legs.

* * * * *